United States Patent [19]

Yoshino et al.

[11] Patent Number: 5,065,693

[45] Date of Patent: Nov. 19, 1991

[54] DEVELOPING DEVICE

[75] Inventors: Kunihisa Yoshino, Mitaka; Mitsuo Motohashi, Fuchu; Yozo Fujii, Hachioji, all of Japan

[73] Assignee: Konica Corporation, Tokyo, Japan

[21] Appl. No.: 654,023

[22] Filed: Feb. 12, 1991

[30] Foreign Application Priority Data

| | | | |
|---|---|---|---|
| Feb. 19, 1990 | [JP] | Japan | 2-36380 |
| Feb. 19, 1990 | [JP] | Japan | 2-36381 |
| Feb. 19, 1990 | [JP] | Japan | 2-36383 |

[51] Int. Cl.[5] ..... G03G 15/09

[52] U.S. Cl. ..... 118/657; 355/245; 355/251

[58] Field of Search ..... 355/245, 251, 253, 260; 118/657, 656

[56] References Cited

U.S. PATENT DOCUMENTS

| | | | |
|---|---|---|---|
| 4,686,934 | 8/1987 | Kohyama | 118/656 X |
| 4,935,781 | 6/1990 | Ito et al. | 355/245 |
| 4,936,249 | 6/1990 | Tajima et al. | 355/251 X |
| 4,987,452 | 1/1991 | Nakagawa et al. | 355/245 |
| 5,012,285 | 4/1991 | Oka et al. | 355/245 |

*Primary Examiner*—A. T. Grimley

*Assistant Examiner*—S. L. Hoffman

*Attorney, Agent, or Firm*—Finnegan, Henderson, Farabow, Garrett, and Dunner

[57] ABSTRACT

A developing device for use in an image recording apparatus, comprising: a developer stirrer which stirs toner and carrier in order to prepare the compostion of developer; a developer supplier which supplies the developer prepared by the developer stirrer; a developer holder which attracts the developer supplied by the developer supplier onto its surface, conveys the developer to the development region; a height regulator which regulates the layer thickness of the developer attracted onto the surface of the developer holder; a developer remover which removes the residual developer from the surface of the developer holder after development; a magnetic conveyor which conveys the developer removed from the developer holder to the region of the developer stirrer; and a mechanical conveyor which is placed in the region between the magnetic conveyor and the developer stirrer, which removes the developer attracted onto the surface of the magnetic conveyor, and moves the removed developer toward the region between the magnetic carrier conveyor and the developer stirrer.

20 Claims, 7 Drawing Sheets

DEVELOPING DEVICE

BACKGROUND OF THE INVENTION

The present invention relates to improvements in developing devices, and particularly relates to improvements in developing devices in which developer is smoothly conveyed, uneven image density does not occur, and further developer does not scatter and leak from the container of the developing device.

Regarding different forms of image recording apparatus, the following are widely known.

(a) An electrophotographic image recording apparatus, which is called an electrophotographic copier.

(b) An image recording apparatus such as a laser beam printer, which is characterized in that: a surface is divided into a plurality of small areas, which will be called dots hereinafter; digital information which indicates coloring or non-coloring, is given to each dot; and an image is formed on the above-described surface according to the digital information.

In these kinds of image recording apparatus, a toner supply means which supplies a coloring agent (which will be called toner hereinafter), is needed on the assumption that an image signal medium, for example an electrophotographic photoreceptor drum on which a latent image is formed, wherein a coloring command is given to the dot on the image signal medium on which coloring is to be conducted and a non-coloring command is given to the dot on which coloring is not to be conducted.

Regarding the toner supply means, toner must be uniformly and detachably attracted to the surface of the toner supply means.

The present invention relates to improvements in this kind of toner supply means, which will be called a developing means in this specification hereinafter.

Referring to FIG. 2*a*, a conventional developing unit will be explained as follows.

In FIG. 2*a*, the numeral (1) is a developer stirring means which is composed of two screws (11) and (12). Toner is supplied to the developer stirring means (1) from a toner casing means (not shown in the drawing) which is located above the developer stirring means (1). The supplied toner is conveyed by the screw (11) to the viewer's side in the drawing. At this moment, in this example, a coloring material carrying means (which will be called a carrier hereinafter), which is composed of particles, the diameter of which is approximately 50 μm, made from magnetic material, is supplied from the side of the screw (12). As a result, the toner and carrier are uniformly stirred and mixed so that they are transformed into a developer.

This developer is uniformly contacted with the surface of the developer conveying means (7) (which is a triangular body of rotation in this example) with pressure by the action of the screw (12), wherein the developer conveying means (7) functions in the subsequent process.

The numeral (3) is a developer holding means which is composed of the sleeve (31), a cylindrical body of rotation, and a magnetic means (32) which is fixed to the inside of the sleeve (31). The surface of the sleeve (31) attracts developer. When the sleeve (31) is rotated and contacted with an image signal medium (for example, an electrostatic photoreceptor drum on which a latent image is formed), which is not illustrated in the drawing, the toner contained in the developer attracted onto the surface of the sleeve (31) is supplied from the sleeve (31) to the latent image formed on the above-described image signal medium so that the above-described latent image can be developed. In the way described above, only carrier is left on the region of the sleeve (31) surface from which the toner was supplied to the latent image, so that the toner concentration on the sleeve (31) becomes uneven.

The function of the above-described magnetic means is as follows: the magnetic means attracts the developer onto the above-described sleeve (31) while development is conducted; and the means removes the residual toner from the above-described sleeve (31) after development has been completed.

The numeral (4) is a developer layer thickness regulating means which controls the developer so that a desirable thickness of developer layer can be formed on the above-described sleeve (31).

The numeral (7) is a developer conveying means which conveys the developer pushed out by the screw (12) to the developer holding means (3), and which conveys the developer (in which the amount of toner is small and the amount of carrier is relatively large) that has been removed from the developer holding means (3) to the region of the developer stirring means (1).

The numeral (9) is a developing unit body in which the above-described units are installed.

The composition of a conventional developing unit has been explained above. On the other hand, the following idea is proposed with regard to the means which conveys the developer removed from the sleeve (31) to the region of the stirring screw (12): for example, a magnetic conveying means composed of a cylindrical rotative body on which a magnetic pole is formed, is used as the developer conveying means; and the removed developer is forcibly conveyed to the region of the developer stirring means (1) by attracting the above-described removed developer onto the rotative body of the magnetic conveying means.

As explained above, in the case of a conventional developing unit, after the toner has been supplied onto the latent image formed on an image signal medium, developer in which relatively small amount of toner is contained compared with the amount of carrier, is left on the region of the sleeve (31), so that the concentration of toner left on the sleeve (31) becomes uneven. Consequently, it is necessary to remove all the toner from the sleeve (31), otherwise the image density will undesirably become uneven when an image is formed next time. However, there is a problem that it is difficult to remove all the toner from the surface of the sleeve (31), so that some of the toner will be left on the surface even after toner removal has been conducted.

Such an idea is essentially disadvantageous in that: in order to efficiently convey the developer removed from the surface of the sleeve (31) to the region of the developer stirring means, a magnetic conveying means which is composed of a cylindrical rotative body, on which surface a magnetic pole is formed, is used so that the above-described developer can be attracted onto its surface and the attracted developer is forcibly conveyed to the region of the developer stirring means (1). The reason why this idea is disadvantageous is that the developer attracted to the cylindrical rotative body by magnetic force can not be completely separated from the body when it is conveyed to the position close to the conveyance screw (12). In other words, a portion of the developer is left on the surface of the above-described rotative body and returned to the region where the toner was initially placed.

Another idea has been put forward: after development has been completed, the residual developer, in which the amount of toner is relatively small compared with the amount of carrier, is forcibly removed by a mechanical method. The inventor has already invented a developing device according to the idea described above, and made an application.

However, there is a problem in the developing device in which the residual developer is forcibly removed from the developer holding means by a mechanical method, which is that the removed developer is scattered and leaks outside the container of the developing device through an opening, and as a result, the image formed on an image signal medium is stained.

Refer to FIG. 2*b* and FIG. 2*c*.

FIG. 2*b* is a sectional side view of a developing device relating to another conventional technology, and FIG. 2*c* is a front view of the developing device, which is taken from its opening.

In FIG. 2*c*, the circumferential surface of the sleeve (31) corresponding to the axial length of the magnetic means (32), is made coarse, by sandblasting for example. This rugged region is actually a developer holding region, which will be called a sandblasted width in this specification hereinafter.

The numeral (91) in FIG. 2*b* is an opening provided to one end of the casing means (9). A portion of the above-described developer holding means (3) is protruded from the opening (91) and opposed to an image signal medium not illustrated in the drawing.

The numeral (10) is a developer spill prevention means made of a velvet-like material. One surface of the developer spill prevention means composed of this material is adhered to the inside of the casing means (9) so that the developer spill prevention means (10) can be opposed to the smooth circumferential surfaces of the above-described sleeve (31), wherein the surface of the middle portion of the sleeve (31) is rugged and the surfaces of the edge portions are smooth. The other surfaces of the developer spill prevention means (10) made of velvet-like material are pressed against the smooth circumferential surfaces provided on both sides of the sleeve (31). The function of the developer spill prevention means (10) is as follows: the leakage of developer from the positions around the smooth surfaces on both sides of the sleeve (31) to the outside of the container of the developing device, can be prevented by the developer spill prevention means (10).

However, the above-described developer spill prevention means is pressed against the circumferential surface of the sleeve which composes the developer holding means, so that high frictional resistance is caused when the developer holding means is rotated. Consequently, high torque is necessary to rotate the developer holding means. As a result, the rotation speed of the developer holding means tends to be varied and the density of recorded images becomes uneven. Accordingly, it has been desired to develop a developing device provided with a means which can prevent the leakage of developer from the casing means without using the conventional developer spill prevention means.

Refer to FIG. 2*a*.

Further, another conventional developing device will be briefly explained as follows.

The rotating members (1), (7) and (3) are generally driven by a single drive means (not illustrated in the drawing). In this case, when the revolution speeds of the rotating members (1), (7) and (3) are varied, the amount of toner supplied to an image signal medium in a unit time is varied, so that uneven density distribution of an image is caused. In order to prevent the unevenness of density, it is common to maintain a constant revolution speed.

In order that uneven image density does not occur and smooth circulation of developer is conducted, there is a developing device comprising: a developer removing means composed of a scraper which removes the developer from the developer holding means (3); and a magnetic conveying means (for example, the magnetic conveying means is composed of a cylindrical rotative body, on the surface of which a magnetic pole is formed) which smoothly conveys the used developer removed from the developer holding means (3) to the region of the developer stirring means (1).

When the developing apparatus according to the above-described idea was realized, it could be confirmed that: the occurrence of uneven image density was effectively prevented; and further the used developer removed from the developer holding means (3) was smoothly conveyed to the region of the magnetic conveying means. However, the following disadvantages were found in this developing unit: the used developer undesirably stays in the region of the magnetic conveying means; and a drive means to drive the magnetic conveying means and the developer holding means (3) could not be smoothly operated due to the residual developer, so that the uneven density distribution was caused in obtained images.

Refer to FIG. 2*a*.

Further, another conventional developing device will be briefly described as follows.

In the developing device illustrated in FIG. 2*a*, gaps of about 1 mm are formed between the upper edge (911) of the casing means (9) and the developer holding means (3), and between the lower edge (912) and the developer holding means (3).

There is a disadvantage in the case of the developing device described above, as follows: when the used developer is mechanically removed from the developer holding means (3) by the developer removing means, the removed developer is scattered and leaks outside the container of the developing device, so that the image signal medium and the recording paper become stained.

SUMMARY OF THE INVENTION

It is a primary object of the present invention to provide a developing device which is characterized in that: uneven image density, by which the density of a formed image becomes undesirably uneven, can be prevented; and the developer can be smoothly circulated in the device.

The second object of the present invention is to provide a developing device which is characterized in that: uneven image density can be prevented; and the powdery developer can not be scattered from the container of the developing device.

The third object of the present invention is to provide a developing device which is characterized in that: uneven image density can be prevented; the developer is smoothly circulated in the device; and each drive means can be rotated without any obstruction, so that the occurrence of uneven density distribution of an image can be prevented.

Refer to FIGS. 1*a*, 1*b* and 1*c*.

The developing device of the present invention comprises: a developer stirring means (1) which stirs toner and carrier in order to prepare the composition of developer; a developer supply means (2) which supplies the developer prepared by the developer stirring means (1); a developer holding means (3) which attracts the developer supplied by the developer supply means (2) onto its surface, conveys the developer to the development region; a height regulating means (4) which regulates the layer thickness of the developer attracted onto the surface of the developer holding means (3); a developer removing means (5) which removes the residual developer from the surface of the developer holding means (3) after development; a magnetic conveying means (6) which conveys the developer removed from the developer holding means (3) to the region of the developer stirring means (1); and a mechanical conveying means (8) which is placed in the region between the magnetic conveying means (6) and the developer stirring means (1), which removes the developer attracted onto the surface of the magnetic conveying means (6), and moves the removed developer toward the region between the magnetic conveying means (6) and the developer stirring means (1).

In the composition described above, the mechanical conveying means (8), which is made from a non-magnetic body (83), may be composed as follows: one end (81) of the mechanical conveying means (8) is placed in the position close to the surface of the magnetic conveying means (6) or contacted with the above-described surface of the magnetic conveying means (6) in the region between the magnetic conveying means (6) and the developer stirring means (1); the other end (82) of the mechanical conveying means (8) is connected with the above-described developer removing means (5); otherwise, in order to form a magnetic shield so that the deterioration of stirring effect of the developer stirring means (1) can be prevented, wherein the deterioration of stirring effect is caused by the influence of the magnetic field of the magnetic conveying means (6), the above-described mechanical conveying means (8) is composed of laminated layers of the non-magnetic body (83) and the magnetic body (84); and only the above-described non-magnetic body (83) of one end (81) of the mechanical conveying means (8) is placed in the position close to the surface of the above-described magnetic conveying means (6) or contacted with the above-described surface of the magnetic conveying means in the region between the magnetic conveying means (6) and the developer stirring means (1), and the other end (82) of the mechanical conveying means (8) is connected with the above-described developer removing means (5).

The developer removing means (5) is preferably provided with a resilient and sharp edge portion so that it can scrape off the attracted developer for a long period of time, and it is preferable that the developer removing means (5) is made from a hard and resilient material with high formability. In order to meet the requirements described above, urethane rubber, phosphor bronze and polyethylene terephthalate are preferably used.

The magnetic conveying means (6) may be a rotative body having a magnet or it may be a magnet which is moved in the direction of the movement of carrier.

Stainless steel, aluminum and rubber are preferably used as the non-magnetic material of the above-described mechanical conveying means (8). It is desirable that the mechanical conveying means (8) is provided with an edge portion which is sufficiently resilient and sharp in order to effectively scrape off the developer for a long period of time.

The cause of uneven image density, which can be solved by the present invention, is the uneven toner concentration of developer which is attracted onto the sleeve (31) constituting the developer holding means (3). This unevenness of toner concentration is caused when the used developer, in which a large amount of carrier is contained, is left on the sleeve (31) surface. Accordingly, it is necessary to completely remove the used developer from the sleeve (31). For that reason, the polarity of the magnetic means (32) which is provided inside the sleeve (31), is aligned so that this object can be attained.

The magnetic means (32) composed in such a manner explained above, functions almost satisfactorily. However, according to the results of experiments conducted by the inventors, it has become clear that when the capacity of scraping off is a little increased, satisfactory performance can be achieved.

Specifically, a magnetic means, an electrical means and a mechanical means can be applied in order to increase the capacity of scraping off. In this case, the mechanical means has been selected in order to remove the used developer mechanically because it is the simplest and most effective method. In this case there is a problem as follows: unless the developer which has been removed from the sleeve surface, in which the amount of carrier is relatively large compared with the amount of toner, is effectively conveyed to the subsequent process, it is left and attracted again onto the sleeve (31) surface; and as a result the concentration of toner on the development sleeve (31) becomes uneven.

In order to solve the problem described above, it has been determined that fine ferrite particles should be used as the carrier in the used developer so that the used developer can be effectively conveyed to the subsequent process. Specifically, the magnetic conveying means (6) is provided and the used developer is magnetically attracted to the means in order to positively convey the used developer to the subsequent process.

Next, the mechanical conveying means (8) is placed in the region between the magnetic conveying means (6) and the developer stirring means (1) in order to solve another problem, which can be described as follows: an amount of carrier is left on the surface of the magnetic conveying means (6), so that the developer can not be smoothly circulated. The residual developer left on the surface of the magnetic conveying means (6) is mechanically removed by the mechanical conveying means (8) in order to circulate the developer smoothly. Specifically, one end (81) of the mechanical conveying means (8) is placed in the position close to the surface of the magnetic conveying means (6) or contacted with the surface in order to simply and effectively scrape off the residual carrier left on the surface. In this case the above-described mechanical conveying means (8) is composed of a non-magnetic body, or a laminated body of a non-magnetic body and a magnetic body. In the former case, one end (81) of the mechanical conveying means (8) is made of a non-magnetic body so that the residual developer on the magnetic conveying means (6) can be easily removed. In the latter case, the mechanical conveying means (8) is made of a laminated body so that the carrier removed by one end (81) made of a non-magnetic body, can be positively attracted by the laminated magnetic body and conveyed to the region where the developer stirring means (1) is placed.

The means to accomplish another object of the present invention is composed as follows.

In FIG. 1*d*, the opening (91) is formed at one end of the casing means (9), which is the main body; a portion of the developer holding means (3) is protruded from the opening (91); and the developer holding means (3) is installed inside the casing means (9) in such a manner that gaps of approximately 1 mm are made between the upper and lower edges (911), (912) of the above-described opening (91) and the developer holding means (3). Further, the following units are installed inside the above-described casing means (9): the height regulating means (4) which is placed in the position close to the developer holding means (9) and regulates the layer thickness of the developer attracted onto the surface of the developer holding means; the developer supply means (2) which supplies the developer to the developer holding means (3); the developer stirring means (1) which is placed in the position close to the developer supply means (2) and stirs the carrier and toner in order to prepare the composition of the developer; and the developer removing means (5), one end of which is contracted with the developer holding means (3) in order to remove the residual developer from the developer holding means (3).

The following units relating to the present invention are added to the developing device described above.

The unit relating to the present invention is the developer leakage prevention means (102) which is placed in the position close to the lower edge (912) of the opening (91) and composed of a magnet, the polarity of which is reverse to that of the magnet in the developer holding means.

The developer leakage prevention means (102) is disposed along the developer holding means (3) in parallel with the rotational axis or longitudinally of the developer holding means.

This magnet may be located in the place between the developer removing means (5) and the lower edge (912) of the opening (91).

As illustrated in FIG. 1*e*, the magnetic pole of reverse polarity to that used in the developer leakage prevention means (102) is located on the reverse side to the magnetic pole opposed to the developer holding means (3). As illustrated in FIG. 1*f*, the polarity of the magnet used in the apparatus of the present invention may be composed in such a manner that: the magnetic pole, the polarity of which is reverse to that of the developer holding means (3), is placed between two magnetic poles, the polarity of which is the same as that of the developer holding means (3).

The developing device according to the present invention, is provided with the developer leakage prevention means (102) (which is the main concept of the present invention), which is located in the position close to the lower edge (912) of the opening (91), and which is composed of a magnet placed in the position opposed to the magnet of the developer holding means (3), and the polarity of the magnet is reverse to that of the developer holding means (3). Accordingly, a magnetic field is formed between the magnets of the developer leakage prevention means (102) and the developer holding means (3).

According to the experiments made by the inventors, the following was found: the carrier particles contained in the developer placed in the above-described magnetic field, were magnetized and attracted with each other so that a body of attracted carrier was formed, and the developer holding means (3) and the developer leakage prevention means (102) were bridged by bodies of attracted carrier, which were formed in parallel with each other, so that the shape of the bodies of attracted carrier was like a curtain, which could prevent the powdery developer (toner) from scattering. Consequently, leakage of developer could be prevented.

Another means to accomplish the second object of the present invention is composed as follows.

(a) The main body of this means is the casing means (9) on which the opening (91) is formed;

(b) the developer holding means (3) is installed in the casing means (9) in such a manner that a portion of the developer holding means (3) is protruded from the opening (91), and that gaps are formed between the upper edge (911) of the opening (91) and the developer holding means (3), and between the lower edge (912) and the developer holding means (3);

(c) the height regulating means (4) is installed in the casing means (9), which is placed in the position close to the developer holding means (3) and regulates the layer thickness of developer attracted onto the surface of the developer holding means (3);

(d) the developer supply means (2) is installed in the casing means (9), which supplies the developer to the developer holding means (3);

(e) the developer stirring means (1) is installed in the position close to the developer supply means (2) in the casing means (9);

(f) the developer removing means (5) is installed in the casing means (9), which removes the residual developer from the developer holding means (3);

(g) the magnetic conveying means (6) is installed in the casing means (9), which conveys the developer removed from the developer holding means (3) to the developer stirring means (1);

(h) and the axial length of the magnetic conveying means (6) is set to be longer than the corresponding length of the magnetic means (32) which constitutes the developer holding means (3).

The length of the magnetic means (32) is generally the same as the axial length (which is defined as the sandblasted width in this specification) of the region of the sleeve (31) of which the surface is finely rugged. Accordingly: the axial length of the magnetic conveying means (6) is longer than the above-described sandblasted width. If the length of the magnetic means (32) is not the same as the sandblasted width, the axial length of the magnetic conveying means (6) is preferably longer than any of the length of the magnetic means (32) and the sandblasted width.

In the developing device of the present invention, the residual developer can be mechanically removed from the surface of the developer holding means (3) by the developer removing means (5), so that the used developer (the toner amount of which is small and the carrier amount of which is relatively large) is completely removed and a layer of developer, the toner density of which is uniform, can be continuously formed and the occurrence of uneven image density can be prevented.

Further, in the developing device of the present invention, the magnetic conveying means (6) magnetically attracts the developer removed from the sleeve

(31) by the developer removing means (5) and conveys the removed developer to the region of the screw (12) of the developer stirring means (1). Consequently, the developing device of the present invention is excellent in the efficiency of conveying the used developer to the region of the developer stirring means.

The developer spill prevention means (10) of a conventional developing device prevents the used developer from leaking outside from both sides of the sleeve (31) which constitutes the developer holding means (3).

The inventors has then considered that: if the used developer does not leak to the outside from the circumferential surfaces of both sides of the sleeve (31) constituting the developer holding means (3), and is positively attracted and conveyed to the region of the developer stirring process, the above-described developer spill prevention means (10) can be omitted; and the variation of revolution speed of the developer holding means (3) due to the developer spill prevention means (10), can be prevented, so that undesirable unevenness of image density which tends to occur in a recorded image can be prevented.

This idea was realized and experiments were repeatedly made in such a manner that: in order to magnetically attract the developer to the developer stirring region, even in the region of both sides of the sleeve (31) which constitutes the developer holding means (3), the axial length of the magnetic conveying means (6) is made longer than the corresponding length of the magnetic means which is installed in the sleeve (31) of the developer holding means (3). According to the results of the experiments, it was confirmed that: when the axial length of the magnetic conveying means (6) is made a little longer than the corresponding length of the magnetic means inside the sleeve (31) of the developer holding means (3) by several millimeters, the leakage of the developer from the container in the developing device to the outside can be prevented, even if the above-described conventional developer spill prevention means (10) is eliminated.

The above-described third object of the present invention can be attained by the developing device which is provided with not only the composition to accomplish the first object of the present invention but also the following composition: one end (81), which is close to the developer stirring means (1), of the mechanical conveying means (8) is separated from the magnetic conveying means (6); and the gap between the end (81) and the magnetic conveying means (6) is not more than 1 mm.

It was also confirmed that: when the other end (82) of the mechanical conveying means (8) is connected with the developer removing means (5) in the above-described composition, the following advantages are acquired such that the developing device can be made compact and further the developer can be smoothly conveyed.

The developer holding means (3) of the developing device of the present invention is provided with the developer removing means (5) composed of a mechanical scraper and provided with the magnetic conveying means (6). The function of the former, the developer removing means (5), is to remove the used developer which is attracted onto the sleeve (31) of the developer holding means (3) with an extremely high efficiency. On the other hand, since the main components of developer are the carrier composed of fine particles of ferrite and the toner composed of coloring agents, the used developer (of which the toner amount is small and the carrier amount is large) is magnetically attracted to the magnetic conveying means (6) due to the magnetism of the carrier, that the developer is conveyed at least to the region of the magnetic conveying means (6) with a high efficiency.

It was found that the above-described used developer caused a problem in that: the used developer was accumulated around the magnetic removing means (6), so that the rotation of the drive means to drive the magnetic conveying means (6) was obstructed, which caused unevenness of images. In order to solve the problem described above, experiments were made in such a manner that: the relative distance between the mechanical conveying means (8) consisting of a scraper and the magnetic conveying means (6) were varied. As a result, it was confirmed that: when the distance between the mechanical conveying means (8) and the magnetic conveying means (6) was not zero and not more than 1 mm, the torque necessary to drive each drive means was small and stable as illustrated in FIG. 3. Consequently, it was confirmed that when the device was operated under the condition that the above-described distance was not zero and not more than 1 mm, unevenness of images was not caused.

Since the mechanical conveying means (8) is provided in the position close to the magnetic conveying means (6) in the developing device of the present invention in such a manner that the mechanical conveying means (8) does not come into contact with the magnetic conveying means (6) and the distance between means (8) and (6) is not more than 1 mm, the developer is not accumulated around the magnetic conveying means (6), so that the torque of each drive means is constant, thus toner concentration is constantly maintained and the occurrence of uneven images can be prevented.

A further means to accomplish the second object of the present invention is the composition to attain the second object, which was described before, and the composition which will be described as follows.

The magnetic flux density (B) of the magnet used in the developer leakage prevention means (102) is 200 to 400 gauss; the shortest distance (l) between the developer leakage prevention means (102) and the developer holding means (3) is 2 to 4 mm; and the relation between the magnetic flux density (B) of the developer leakage prevention means (102) and the above-described shortest distance (l) corresponding to (B) can be given by the equation of $$0.006B+0.7 \leqq l \leqq 0.006B+1.1$$

where the unit of magnetic flux density (B) is expressed by gauss and the unit of the shortest distance (l) is expressed by mm.

The developing device of the present invention is provided with the developer removing means (5) composed of a mechanical scraper of which one end comes into contact with the developer holding means (3), and provided with the magnetic removing means (6). The former means, the developer removing means (5), can very effectively remove the used residual developer from the sleeve (31) of the developer holding means (3). On the other hand, since the main components of developer are the carrier composed of fine ferrite particles and the toner composed of coloring agents, the used developer is attracted by the magnetic conveying means (6) due to the magnetism of the carrier composed of ferrite, and conveyed to the region of the developer stirring means (1), so that the occurrence of uneven image density can be prevented.

The developing device according to the present invention, is provided with the developer leakage prevention means (102) (which is the main concept of the present invention), which is located in the position close to the lower edge (912) of the opening (91), and which is composed of a magnet placed in the position opposed to the magnet of the developer holding means (3), and the polarity of the magnet is reverse to that of the developer holding means (3). Accordingly, a magnetic field is formed between the magnets of the developer leakage prevention means (102) and the developer holding means (3).

The carrier particles which are contained in the developer placed in the above-described magnetic field, are magnetized and attracted with each other so that a body of attracted carrier is formed, and the developer holding means (3) and the developer leakage prevention means (102) are bridged by the body of attracted carrier. The bodies of attracted carrier are formed in parallel with each other, so that the shape of the bodies of attracted carrier is like a curtain, which can prevent the powdery developer from scattering outside of the casing means (9) of the developing device. Consequently, the leakage of developer can be prevented.

According to the results of experiments made by the inventors, it was found that: in order to positively prevent the leakage of the developer, the following equation must be satisfied $$0.006B+0.7 \leqq l \leqq 0.006B+1.1$$

where l is the shortest distance between the developer holding means (3) and the developer leakage prevention means (102), and B is the magnetic density peculiar to the magnet which constitutes the developer leakage prevention means (102), wherein the unit of l is mm and the unit of B is gauss.

To explain in further detail, it was confirmed by the experiments made by the inventors that: when the value l was smaller than the lower limit value indicated by the above equation, the developer came out from the opening (91) and when the value l was larger than the upper limit value indicated by the above equation, the toner in the developer separated by the developer removing means (5) and was scattered from the opening (91).

The inventors have been studying the above-described fact from a physical viewpoint, but it can be speculated as follows.

When the value l is smaller than the lower limit value indicated by the above equation, the used toner left on the developer holding means (3) is dropped by the frictional motion and spilt from the opening (91).

When the value l is larger than the upper limit value indicated by the above equation, the intensity of the magnetic field formed between the magnetic pole of the developer holding means (3) and that of the developer leakage prevention means (102) is reduced, and the number of connected carrier bodies which bridge the magnetic means (32) with the developer leakage prevention means (102) of the present invention. As a result, the toner leakage preventing function is deteriorated and the splash of toner is caused.

DESCRIPTION OF THE PREFERRED EMBODIMENTS

Figure 1A:
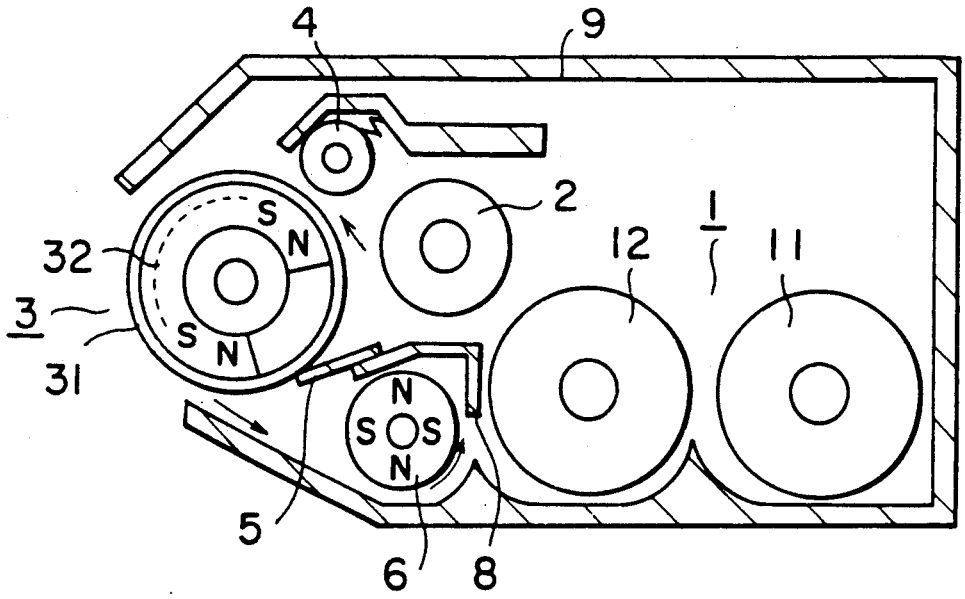
FIG. 1*a* is a sectional view of an example of the present invention.
Figure 1B:
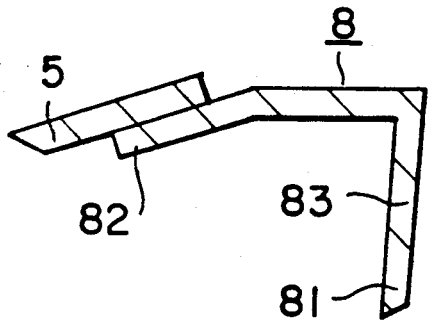
FIG. 1*b* is a sectional view of an example of the mechanical conveying means of the developing device of the present invention.

Referring now to the drawings, the first example of the developing device of the present invention will be explained as follows.

Refer to FIG. 1*a*.

In FIG. 1*a*, the numeral (1) is a developer stirring means which is composed of two screws. Toner is supplied to the developer stirring means from a toner supply means which is installed in the upper position of the developer stirring means. The supplied toner is conveyed by the right screw to the viewer's side. While the toner is being conveyed by the screw, a coloring agent conveying means (which will be called a carrier hereinafter), is supplied from the side of the screw (12), wherein the carrier is composed of particles having a diameter of approximately 50 mm, made from magnetic material. The supplied toner and carrier are stirred, uniformly mixed, and converted into a developer. This developer is conveyed to the subsequent process by the screw (12).

The numeral (2) is a developer supply means which may be composed of a cylindrical body of rotation, the surface of which is porous and rugged. The developer pushed out by the above-described screw (12) can be effectively conveyed by the action of the rugged surface.

The numeral (3) is a developer holding means which is composed of the sleeve (31) which is a cylindrical body of rotation, and the magnetic means (32) which is stationary and installed inside the sleeve (31). The function of the sleeve (31) is as follows: the sleeve (31) conveys the developer attracted onto its surface and supplies the developer to an image signal medium (for example an electrostatic photoreceptor drum) on which a latent image is formed; and the used developer is removed from the surface of the sleeve (31).

The numeral (4) is a height regulating means which is composed of a roller supported by a resilient member. The thickness of the developer layer formed on the sleeve (31) is regulated to a desirable value by the height regulating means.

The numeral (5) is a developer removing means of the present invention, the function of which is to mechanically remove the used developer from the surface of the sleeve (31). The developer removing means (5) is preferably provided with a resilient and sharp edge portion so that it can scrape off the attracted developer for a long period of time, and it is preferable that the developer removing means (5) is made from a hard and resilient material with high formability. In order to meet the requirements described above, urethane rubber, phosphor bronze and polyethylene terephthalate are preferably used.

The numeral (6) is a magnetic conveying means of the present invention which magnetically attracts the carrier removed from the sleeve (31) by the above-described developer removing means (5) and conveys the carrier to the subsequent process. Although the magnetic conveying means (6) is composed of a rotative body around the circumferential surface of which a plurality of magnets are provided, a moving magnetic field which moves in the direction of carrier movement may be utilized instead of the rotative magnetic body.

Figure 1C:
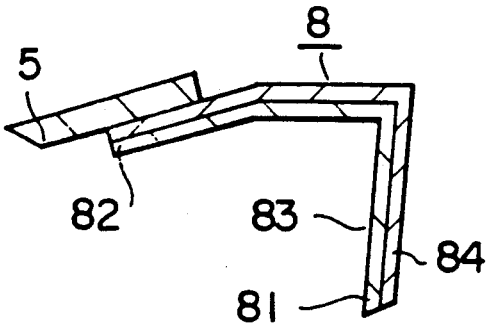
FIG. 1*c* is a sectional view of another example of the mechanical conveying means of the developing device of the present invention.

The numeral (8) is a mechanical conveying means of the present invention, which is located in the region between the magnetic conveying means (6) and the developer stirring means (1) and one end (81) of which is placed in the position close to the surface of the magnetic conveying means (6) or contacted with the surface. The function of the mechanical conveying means (8) is to mechanically remove the residual carrier from the surface of the magnetic conveying means (6) by one end (81). In this example, the other end (82) of the mechanical conveying means (8) is connected with the developer removing means (5). This mechanical conveying means (8) may be a non-magnetic body (83) made from stainless steel, aluminum or rubber, or otherwise the mechanical conveying means may be composed of a laminated body made of the non-magnetic body (83) and the magnetic body (84) (which is illustrated in FIG. 1*c*). In the former case, it is easy to remove the residual carrier from the magnetic conveying means (6). In the latter case, the carrier removed by one end (81) of the non-magnetic body (83) is positively attracted by the laminated magnetic body (84) so that the carrier can be effectively conveyed to the region of the developer stirring means (1). In any case, it is preferable that the above-described non-magnetic body (83) is resilient enough, provided with a sharp edge and the scraping efficiency can be maintained for a long period of time.

The carrier conveyed by the magnetic conveying means (6) and the mechanical conveying means (8) is conveyed to the region of the developer stirring means (1) and mixed with toner again so that the carrier can be converted into developer, the toner concentration of which is a desired value. The developer obtained in the manner described above is conveyed to the region of the developer supply means (2) by the screw (12).

The numeral (9) is a developing device body in which the above-described units are installed.

Referring now to the drawings, the second example of the developing device of the present invention will be explained as follows.

Figure 1D:
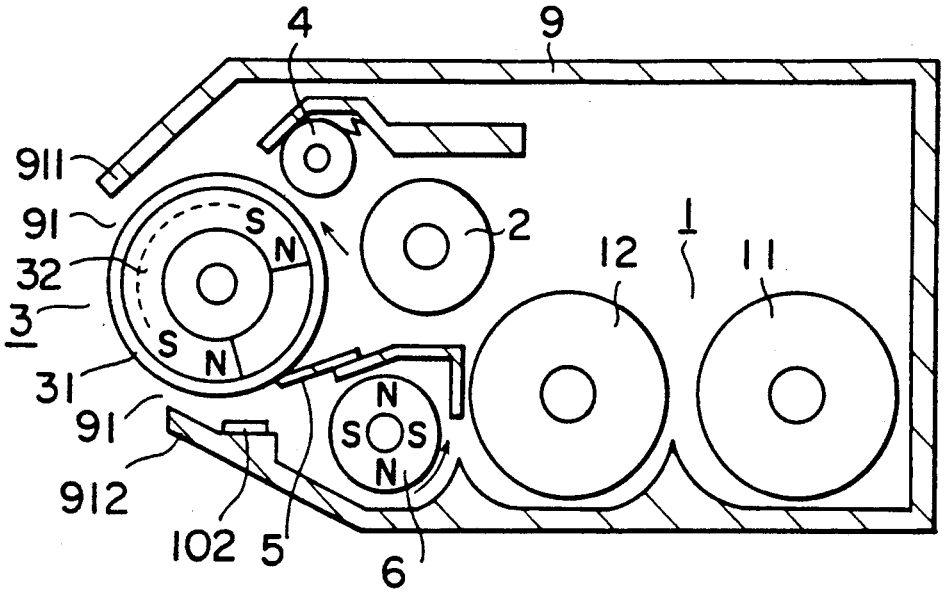
FIG. 1*d* is a sectional view of another example of the developing device of the present invention.

Refer to FIG. 1*d*.

In FIG. 1*d*, the numeral (1) is a developer stirring means, which is composed of two screws (11) and (12). Toner is successively supplied from a toner supply means (not illustrated in the drawing) to the screw (11) illustrated on the right side in the drawing. On the other hand, carrier is successively supplied from the screw (12) illustrated on the left side in the drawing to the screw (11) illustrated on the right side. The supplied toner and carrier are uniformly stirred and mixed by the screws (11) and (12) so that they are converted into developer. The converted developer is conveyed by the screw (12) to the region of the developer supply means (2) which will be described as follows.

The developer supply means (2) is composed of, for example, a cylindrical rotative body of which surface is porous and rugged. The developer supplied by the above-described developer stirring means (1) is effectively conveyed by the developer supply means (2) of which surface is rugged, in the left direction in the drawing.

The numeral (3) is a developer holding means which is composed of the sleeve (31) which is a cylindrical body of rotation, and the magnetic means (32) which is stationary and installed inside the sleeve (31). The function of the sleeve (31) is as follows: the sleeve (31) conveys the developer attracted onto its surface and supplies the developer to an image signal medium (for example an electrostatic photoreceptor drum) on which a latent image is formed; and the used developer is removed from the surface of the sleeve (31).

The function of the magnetic means (32) is as follows: the developer conveyed by the developer supply means (2) is attracted onto the sleeve (31) by the action of the magnetic means (32); the attracted condition is maintained; and the used developer is released from the sleeve (31). In the region in which the developer is released from the surface of the sleeve (31), there is no magnetic pole, and at the end of the region in which the developer is to be attracted, a magnetic pole, the polarity of which is the same as that of the developer, is installed.

The numeral (4) is a height regulating means which is composed of a roller supported by a resilient member. The thickness of the developer layer formed on the sleeve (31) is regulated to a desirable value by the height regulating means.

The numeral (5) is a developer removing means of the present invention, the function of which is to mechanically remove the used developer from the surface of the sleeve (31). The developer removing means (5) is preferably provided with a resilient and sharp edge portion so that it can scrape off the attracted developer for a long period of time, and it is preferable that the developer removing means (5) is made from a hard and resilient material with high formability. In order to meet the requirements described above, urethane rubber, phosphor bronze and polyethylene terephthalate are preferably used.

The numeral (6) is a magnetic conveying means which magnetically attracts the developer (the amount of toner of which is small and the amount of carrier is relatively large) removed from the sleeve (31) by the above-described developer removing means (5) and conveys the carrier to the region of the developer stirring means (1). Although the magnetic removing means (6) is composed of a rotative body around the circumferential surface of which a plurality of magnets are provided, a moving magnetic field which moves in the direction of the used developer movement may be utilized instead of the rotative magnetic body.

As described above, the used developer (the toner amount of which is small and the carrier amount is relatively large) which was conveyed to the region of the developer stirring means (1), is mixed with toner and converted into developer of which toner concentration is desirably made uniform. Then the developer is conveyed to the region of the developer supply means (2) by the screw (12).

The numeral (9) is a casing means in which each means described above is installed. The numeral (91) is an opening which is formed at one end of the casing means (9). A portion of the developer holding means (3) is protruded from the opening (91) and opposed to an image signal medium (not illustrated in the drawing). At the above-described opening (91), the gap between the upper edge (911) of the casing means (9) and the developer holding means (3), and the gap between the lower edge (912) and the developer holding means (3) are approximately set to 1 mm.

The numeral (102) is a developer leakage prevention means of the present invention. This developer leakage prevention means (102) is composed of a magnet, the polarity of which is reverse to that of the magnet of the developer holding means (3) opposed to the developer leakage prevention means (103). The developer leakage prevention means (102) is located in the position between the developer removing means (5) and the lower edge (912) of the opening (91). A magnetic field is formed between both magnetic poles which have the polarity reverse to each other.

Figure 1E:
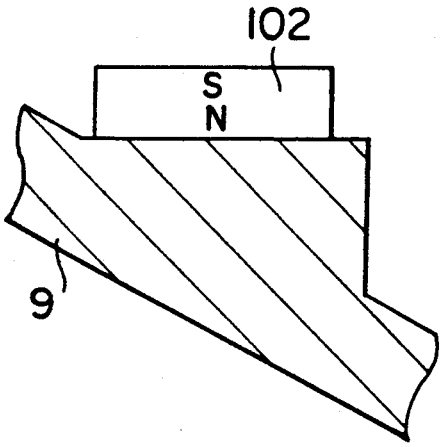
FIG. 1*e* is a sectional view of an example of the developer leakage prevention means used in the developing device of the present invention.
Figure 1F:
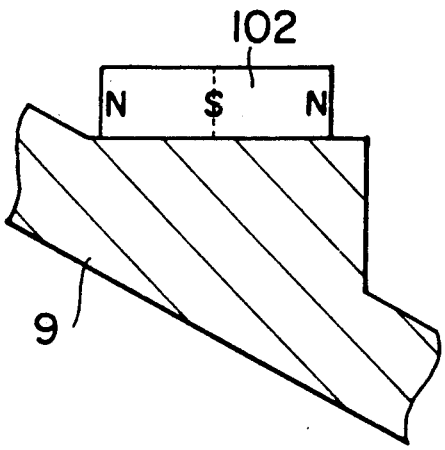
FIG. 1*f* is a sectional view of another example of the developer leakage prevention means used in the developing device of the present invention.

According to the experiments made by the inventors, it was confirmed that: the carrier located in the magnetic field is attracted with each other and formed to a connected body, which bridges the developer holding means (3) with the developer leakage prevention means (102). Further, it was confirmed that: a plurality of connected bodies of attracted carrier were aligned in parallel with each other and the shape of which was like a curtain, so that the scatter and leakage of the powdery developer (toner) could be effectively prevented. This developer leakage prevention means (102) may be composed of a rubber-magnet and the magnet composition may be as shown in FIG. 1*e*, and may be as shown in FIG. 1*f*. The developer leakage prevention means (102) illustrated in FIG. 1*e* is the most practical since the positioning can be easily conducted.

Figure 2A:
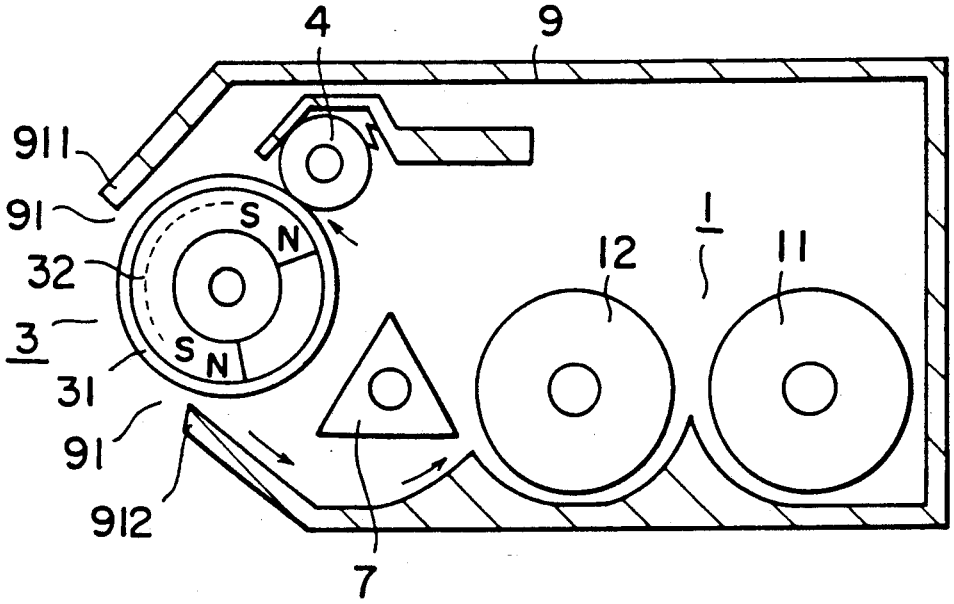
FIG. 2a PRIOR ART
FIG. 2*a* is a sectional view of a conventional developing device.
Figure 2B:
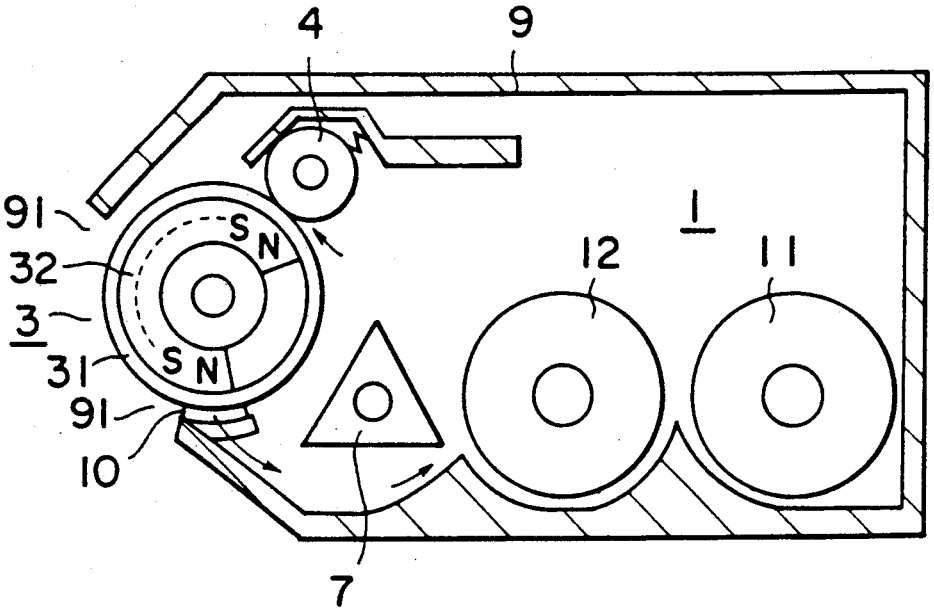
FIG. 2b PRIOR ART
FIG. 2*b* is a side sectional view of another conventional developing device.
Figure 2C:
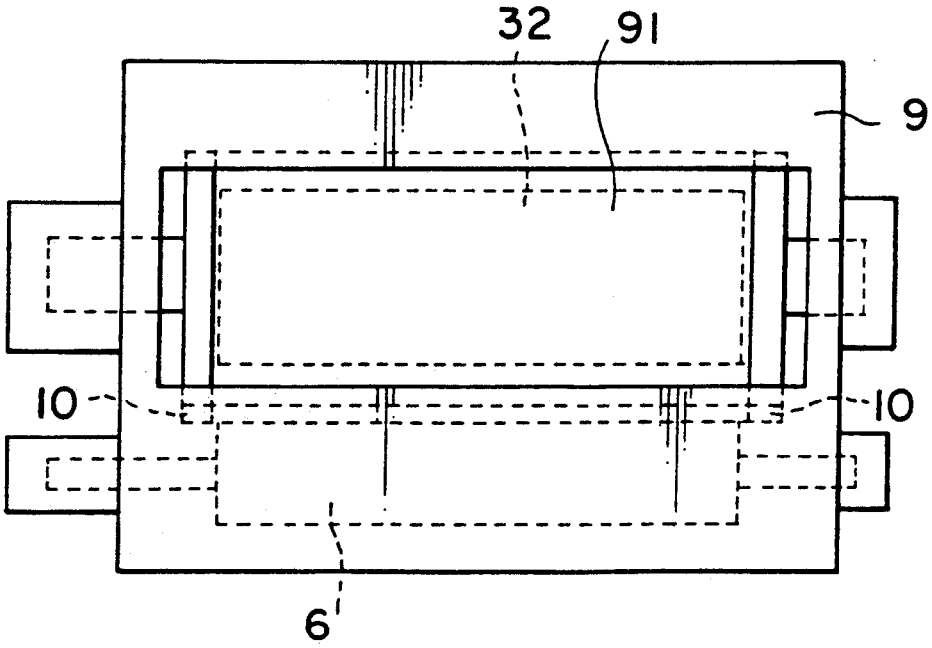
FIG. 2c PRIOR ART
FIG. 2*c* is a front view of the conventional developing unit, wherein the view is taken from the side of the opening.
Figure 3:
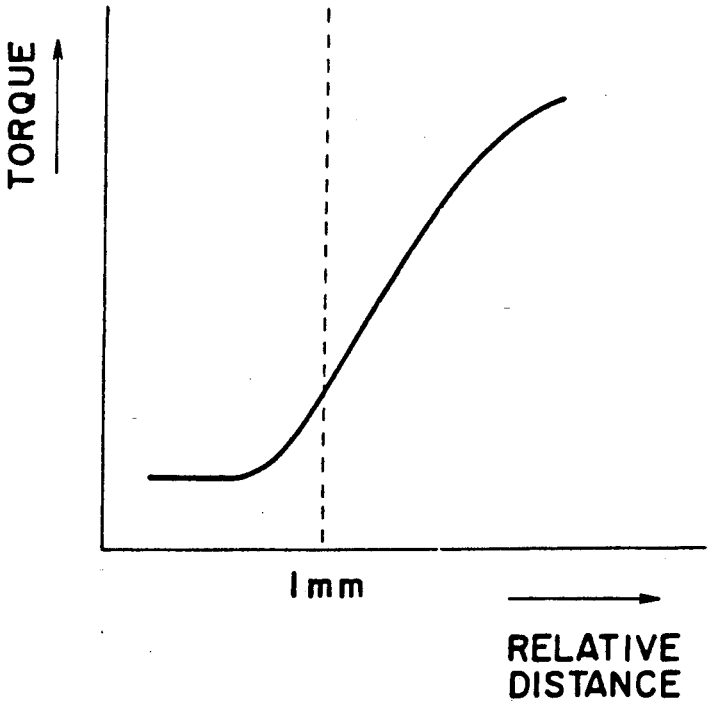
FIG. 3 is a graph showing the principle of the present invention, wherein the relation between the relative distance from a mechanical conveying means to a magnetic conveying means and the torque of each drive means is shown in the graph.

The leakage of developer from the casing means (9) is more positively prevented by using the developer leakage prevention means (102) together with the conventional developer spill prevention means (10) described in FIG. 2*b* and FIG. 2*c*.

Referring now to the drawings, the third example of the developing device according to the present invention will be explained explained as follows.

Figure 1G:
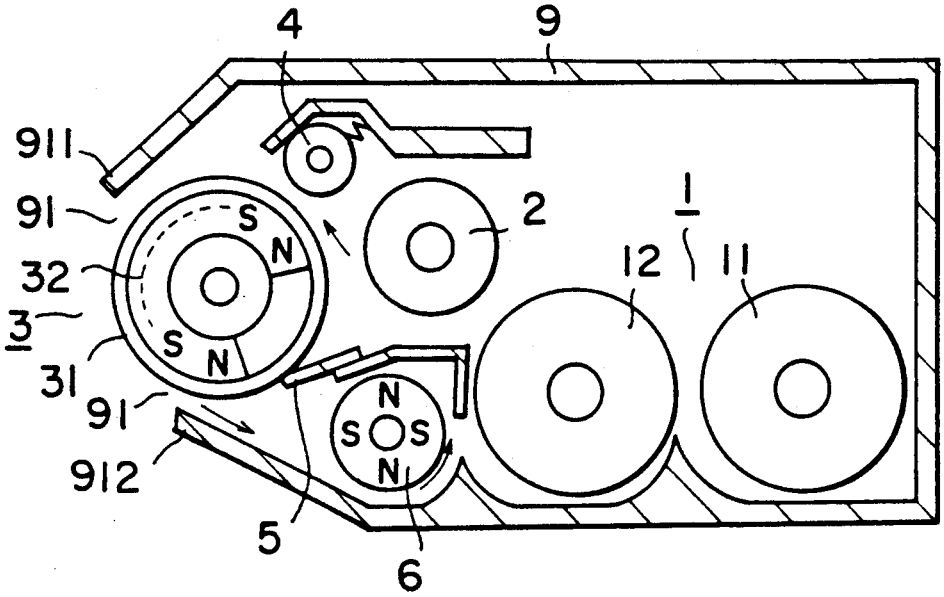
FIG. 1*g* is a side sectional view of another example of the developing device of the present invention.
Figure 1H:
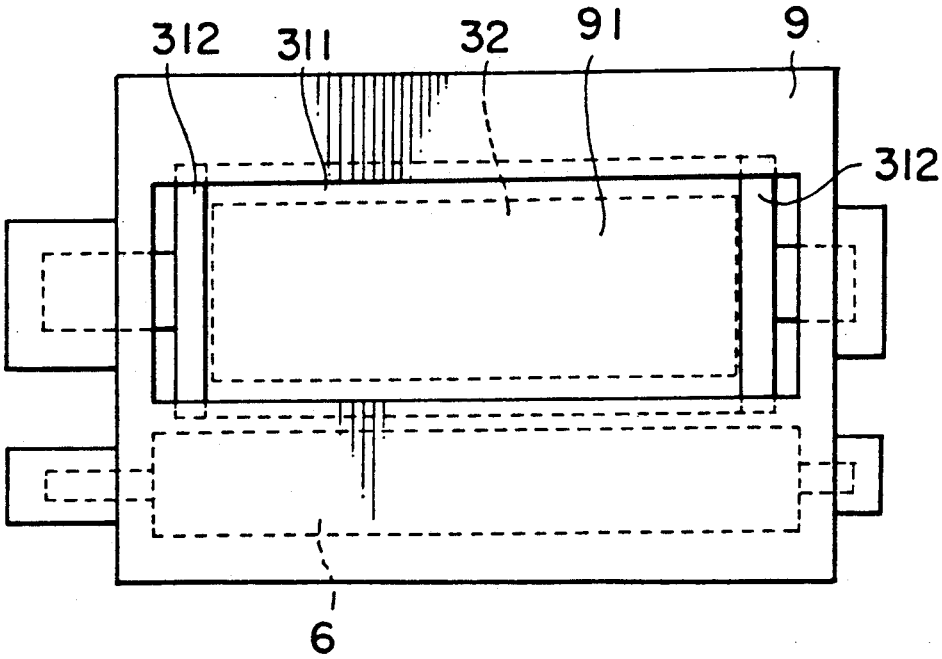
FIG. 1*h* is a front view of an example of the developing device of the present invention, wherein the view is taken from the side of the opening.

Refer to FIG. 1*g* and FIG. 1*h*.

FIG. 1*g* is a side sectional view of this example and FIG. 1*h* is a front view of this example which is taken from the direction of an opening.

In the drawing, the numeral (1) is a developer stirring means, which is composed of two screws (11) and (12) in this example, and which conveys the developer consisting of carrier and toner to the developer supply means (2).

The developer supply means (2) is composed of, for example, a cylindrical rotative body of which surface is porous and rugged. The developer supplied by the above-described developer stirring means (1) is effectively conveyed by the developer supply means (2) of which surface is rugged, in the left direction in the drawing.

The numeral (3) is a developer holding means which is composed of the sleeve (31) which is a cylindrical body of rotation, and the magnetic means (32) which is stationary and installed inside the sleeve (31). The middle portion of the circumferential surface of the sleeve (31) is a finely rugged sand-blasted surface (311) which was processed by sand-blasting. Smooth surfaces (312) are continuously connected with both sides of the blasted surface (311).

In this case, generally speaking, the axial length of the blasted surface (311) of the developer holding means (3) is approximately the same as the corresponding length of the magnetic means (32). The function of the blasted surface (311) is to positively hold the developer using the friction of the rugged surface. The developer holding means (3) supplies the developer attracted onto the blasted surface (311) of the sleeve (31) to a latent image formed on an image signal medium (for example, an electrostatic photoreceptor drum), and removes the used developer. After removing, the developer holding means (3) conveys the used developer to the region of the developer stirring means (1). On the other hand, the function of the magnetic means (32) is to hold the developer on the sleeve (31) while the toner is supplied to a latent image formed on the photoreceptor (in other words, while the latent image is being developed), and to release the used developer from the above-described sleeve (31) after development.

The numeral (4) is a height regulating means which is composed of a roller supported though a resilient member. The thickness of the developer layer formed on the surface of the sleeve (31) is regulated to a predetermined thickness by the height regulating means (4).

The numeral (5) is a developer removing means of the present invention, the function of which is to mechanically remove the used developer from the surface of the sleeve (31). The developer removing means (5) is provided with a resilient and sharp edge portion so that it can positively scrape off all the attracted developer. Accordingly, the occurrence of uneven image density can be prevented.

The numeral (6) is a magnetic conveying means which magnetically attracts the developer (the amount of toner of which is small and the amount of carrier is relatively large) removed from the sleeve (31) by the above-described developer removing means (5) and conveys the carrier to the region of the developer stirring means (1). Although the magnetic removing means (6) is composed of a rotative body around the circumferential surface of which a plurality of magnets are provided, a moving magnetic field which moves in the direction of the used developer movement may be utilized instead of the rotative magnetic body.

The axial length of the magnetic conveying means (6) is related to the concept of the present invention. In the case of the apparatus of the present invention, the axial length of the magnetic conveying means (6) is made longer than the corresponding length of the magnetic means (32) which is provided inside the sleeve (31). As a result, the developer which is going to leak out from the position close to the circumferential surfaces of both sides of the sleeve (31), is attracted by the above-described magnetic conveying means (6), so that the developer can be prevented from leaking out from the developing container.

The numeral (9) is a casing means in which each means is installed. The numeral (91) is an opening which is formed at the end of the casing means (9). A portion of the developer holding means (3) is protruded from the opening (91) and opposed to an image signal medium (not illustrated in the drawing). At the above-described opening (91), the gap between the upper edge (911) of the casing means (9) and the developer holding means (3), and the gap between the lower edge (912) and the developer holding means (3) are approximately set to 1 mm.

Referring now to the drawings, the fourth example of the developing device of the present invention will be explained as follows.

Refer to FIG. 1*a*.

In the drawing, the numeral (1) is a developer stirring means, which is composed of two screws (11) and (12) in this example. Toner is successively supplied from a toner supply means (not illustrated in the drawing) to the screw (11) illustrated on the right side in the drawing. The supplied toner is mixed with the carrier circulating in the developing device so that the developer is prepared.

The developer supply means (2) is composed of, for example, a cylindrical rotative body of which surface is porous and rugged. The developer supplied by the above-described screw (12) is conveyed by the developer supply means (2) to the region of the developer holding means (3).

The numeral (3) is a developer holding means which is composed of the sleeve (31) which is a cylindrical body of rotation, and the magnetic means (32) which is stationary and installed inside the sleeve (31). The function of the sleeve (31) is as follows: the sleeve (31) conveys the developer attracted onto its surface and supplies the developer to an image signal medium (for example an electrostatic photoreceptor drum) on which a latent image is formed; and the used developer is removed from the surface of the sleeve (31).

The function of the magnetic means (32) is to hold the developer on the sleeve (31) while the toner is supplied to a latent image formed on the photoreceptor (in other words, while the latent image is being developed), and to release the used developer from the above-described sleeve (31) after development.

The numeral (4) is a height regulating means which is composed of a roller supported though a resilient member. The thickness of the developer layer formed on the surface of the sleeve (31) is regulated to a predetermined thickness by the height regulating means (4).

The numeral (5) is a developer removing means of the present invention, the function of which is to mechanically remove the used developer from the surface of the sleeve (31). The developer removing means (5) is preferably provided with a resilient and sharp edge portion so that it can scrape off the attracted developer for a long period of time, and it is preferable that the developer removing means (5) is made from a hard and resilient material with high formability. In order to meet the requirements described above, urethane rubber, phosphor bronze and polyethylene terephthalate are preferably used.

The numeral (6) is a magnetic conveying means which magnetically attracts the developer removed from the sleeve (31) by the above-described developer removing means (5) and conveys the carrier to the region of the developer stirring means (1). Although the magnetic removing means (6) is composed of a rotative body around the circumferential surface of which a plurality of magnets are provided, a moving magnetic field which moves in the direction of the used developer movement may be utilized instead of the rotative magnetic body.

The numeral (8) is the mechanical conveying means of the present invention. The mechanical conveying means (8) is placed between the magnetic conveying means (6) and the developer stirring means (1). One end (81) of mechanical conveying means (8) is located in the position close to the magnetic conveying means (6). The distance between one end (81) of the mechanical conveying means which is close to the developer stirring means (1), and the magnetic conveying means (6) is not more than 1 mm, which is the concept of the present invention.

If the other end (82) of the mechanical conveying means (8) is connected with the developer removing means (5), the developer can be smoothly conveyed.

This mechanical conveying means (8) can be composed of a non-magnetic body made from stainless steel, aluminum and rubber.

The carrier conveyed by the magnetic conveying means (6) and the mechanical conveying means (8) is conveyed again to the region of the developer stirring means (1), and uniformly mixed again with the toner so that the carrier is converted into a developer having a predetermined toner concentration. After that, the developer is conveyed to the region of the developer supply means (2) by the screw (12).

The numeral (9) is a casing means in which the above-described units are installed.

Referring now to the drawings, the fifth example of the developing device of the present invention will be described as follows.

Refer to FIG. 1*d*.

In FIG. 1*d*, the numeral (1) is a developer stirring means which is composed of two screws. Toner is supplied to the developer stirring means from a toner supply means which is installed in the upper position of the developer stirring means. The supplied toner is conveyed by the right screw to the viewer's side. While the toner is being conveyed by the screw, a carrier is supplied. The supplied toner and carrier are stirred, uniformly mixed, and converted into a developer.

The numeral (2) is a developer supply means which conveys the developer stirred by the developer stirring means (1) to the region of the developer holding means (3).

The numeral (3) is a developer holding means which is composed of the sleeve (31) which is a cylindrical body of rotation, and the magnetic means (32) which is stationary and installed inside the sleeve (31). The function of the sleeve (31) is as follows: the sleeve (31) conveys the developer attracted onto its surface and supplies the developer to an image signal medium (for example an electrostatic photoreceptor drum) on which a latent image is formed; and the used developer is removed from the surface of the sleeve (31).

The magnetic means (32) has the following function: it attracts the developer conveyed by the developer supply means (2) onto the sleeve (31), holds the attracting condition, and releases the used developer from the sleeve (31).

The numeral (4) is a height regulating means which is composed of a roller supported by a resilient member. The thickness of the developer layer formed on the sleeve (31) is regulated to a desirable value by the developer layer thickness regulating means.

The numeral (5) is a developer removing means of the present invention, the function of which is to mechanically remove the used developer (in which the ratio of the carrier to the toner is not uniform with regard to the regions on the sleeve (31) of the developer holding means (3)) from the surface of the sleeve (31). The developer removing means (5) is provided with a resilient and sharp edge portion, and the developer removing means (5) is made from a hard and resilient material with high formability. In order to meet the requirements described above, urethane rubber, phosphor bronze and polyethylene terephthalate are preferably used. The effect of this developer removing means (5) is as follows: after development, all the used developer is removed from the developer holding means (3), so that the occurrence of uneven image density can be effectively prevented.

The numeral (6) is a magnetic conveying means of the present invention which magnetically attracts the used developer removed from the sleeve (31) by the above-described developer removing means (5) and conveys the carrier to the subsequent process. Although the magnetic removing means (6) is composed of a rotative body around the circumferential surface of which a plurality of magnets are provided, a moving magnetic field which moves in the direction of carrier movement may be utilized instead of the rotative magnetic body.

The used developer which has been conveyed by the magnetic conveying means (6) is conveyed to the region of the developer stirring means (1), and mixed again with the toner so that the ratio of the toner to carrier can be adjusted. The developer prepared in the manner described above is conveyed to the region of the developer supply means (2) by the developer stirring means (1).

The numeral (9) is a casing means in which each means described above is installed. The numeral (91) is an opening which is formed at one end of the casing means (9). A portion of the developer holding means (3) is protruded from the opening (91) and opposed to an image signal medium (not illustrated in the drawing). At the above-described opening (91), the gap between the upper edge (911) of the casing means (9) and the developer holding means (3), and the gap between the lower edge (912) and the developer holding means (3) are approximately set to 1 mm.

The numeral (102) is a developer leakage prevention means of the present invention. This developer leakage prevention means (102) is composed of, for example, a rubber magnet. This developer leakage prevention means (102) is composed of a magnet, the polarity of which is reverse to that of the magnet of the magnetic means (32), wherein the magnet of the developer leakage prevention means (102) is opposed to that of the magnetic means (32). The magnetized carrier body connects both magnetic poles which are opposed to each other, and the polarities of them are reverse to each other, so that the carrier contained in the developer can be prevented from scattering from the opening (91).

In order to positively attain the object of preventing the carrier contained in the developer from scattering, there exists a necessary condition between the shortest distance l from the developer holding means (3) to the developer leakage prevention means (102), and the magnetic flux density B which is peculiar to the magnet constituting the developer leakage prevention means (102). The necessary condition is shown as follows, which is the concept of the present invention, wherein the unit of magnetic flux density B is gauss and that of the shortest distance l is mm.

$$0.006B+0.7 \leqq l \leqq 0.006B+1.1$$

Figure 4:
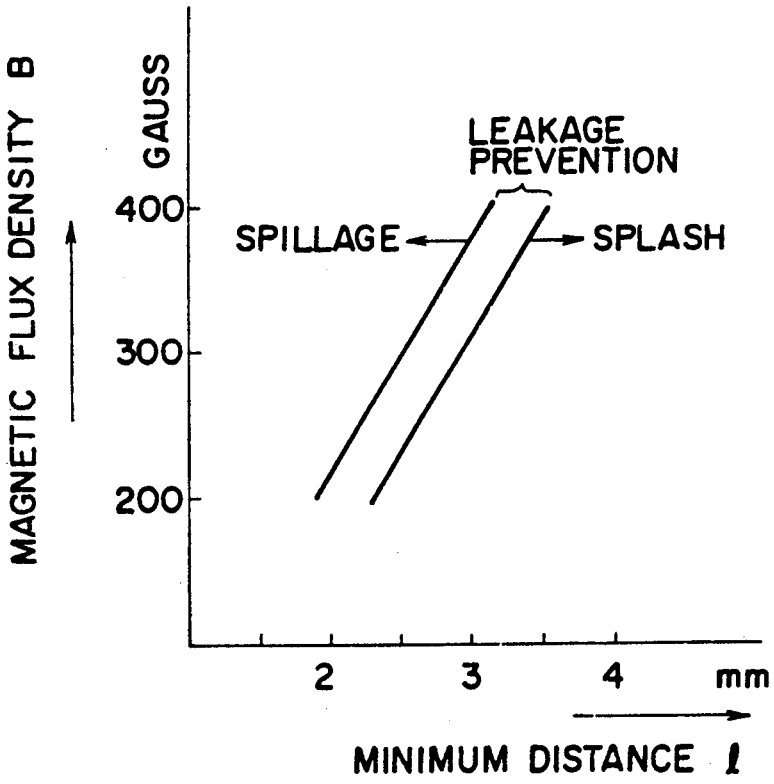
FIG. 4 is a graph which shows the relation between the magnetic flux density peculiar to the magnet constituting the developer leakage prevention means of the present invention, and the shortest distance from the developer holding means to the developer leakage prevention means.

When the value l is smaller than the lower limit value indicated by the above equation, the developer is spewed from the opening (91) and when the value l is larger than the upper limit value indicated by the above equation, the toner in the developer is scattered from the opening (91). FIG. 4 is a graph which shows the relation between the shortest distance l and the magnetic flux density B.

As explained above, since the developing device of the present invention is provided with a developer removing means which mechanically removes the used developer from the sleeve constituting the developer holding means, all of the used developer (in which the amount of carrier is large and the amount of toner is small) is almost completely removed from the sleeve and new developer of which toner density is uniform is attracted onto the sleeve. Development is conducted by the developer of uniform density, so that the occurrence of uneven image density can be prevented. Since the developing device of the present invention is provided with a magnetic conveying means and a mechanical conveying means, the carrier removed from the surface of the sleeve by the above-described developer removing means, is magnetically attracted by the magnetic conveying means and positively conveyed to the region of the developer stirring means. The residual toner left on the surface of the magnetic removing means is mechanically removed by the mechanical conveying means and conveyed, so that the conveyance of carrier is more positively performed and the developer is more smoothly circulated.

Further, the developer leakage prevention means is installed in the position close to the lower edge of the opening provided to the casing means of the developing device of the present invention, which developer leakage prevention means is composed of a magnet, the polarity of which is reverse to that of the magnet of the magnetic means, wherein the magnet of the developer leakage prevention means is opposed to that of the magnetic means. Consequently, the used developer, especially the carrier, is magnetized in the region of the developer leakage prevention means, and the carrier is attracted with each other and the connected body of attracted carrier is formed. The developer holding means and the developer leakage prevention means are bridged by the connected body of attracted carrier. As a result, the powdery developer can be effectively prevented from scattering from the casing means. Accordingly, the apparatus and recording papers can be prevented from being stained by the developer.

Further, the apparatus of the present invention is advantageous as follows. Since the developing device of the invention is provided with a developer removing means composed of a member made from a hard elastic material having sharp edges, almost all of the used developer attracted onto the sleeve constituting a developer holding means can be completely removed and a developer having a desirable ratio of toner to carrier is newly attracted. The following image forming (development and transfer) is conducted by this developer having a desirable ratio of toner to carrier. As a result, the occurrence of uneven image density can be prevented.

The developing device of the present invention is also provided with a magnetic conveying means. The axial length of the magnetic conveying means is a little longer (by several millimeter) than the corresponding length of the magnetic means installed inside the sleeve of the developer holding means, so that the leakage of the developer from the container can be prevented and the developer can be smoothly circulated in the developing device. As explained above, the corresponding length of the magnetic means installed inside the sleeve of the developer holding means is approximately the same as the length (which is the blasted width) of the region of which the surface is finely rugged.

According to the results of experiments conducted by the inventors, the following fact was confirmed: the developing device of the present invention can be effectively applied not only to the case in which a two-component developer is used but also to the case in which one-component developer is used.

Further, one end of the mechanical conveying means is located in the position close to the developer stirring means, the distance of which is not more than 1 mm, so that the occurrence of uneven image density is effectively prevented and the used developer removed from the developer holding means can be smoothly conveyed to the region of the magnetic conveying means, and further the developer does not remain in the region of the magnetic conveying means too long. Accordingly, the torque of each drive means can be constantly maintained regardless of the amount of the developer which exists in the position close to the magnetic conveying means. Therefore, the amount of developer attracted onto the unit surface of the developer holding means can be kept constant and uniform, so that the unevenness of image can be prevented.

In the developing device of the present invention, when the other end of the mechanical conveying means is connected with the developer removing means, the developer can be further smoothly conveyed.

Furthermore, the developing device of the present invention is composed as follows: a developer leakage prevention means composed of a magnet is provided in the position close to the opening of the container of the developing device; the above-described magnet, the polarity of which is reverse to that of the developer holding means, is opposed to the magnet of the developer holding means; and further the relation between the shortest distance l from the developer leakage prevention means to the developer holding means, and magnetic flux density B peculiar to the magnet constituting the developer leakage prevention means, can be expressed by the following inequality, $$0.006B+0.7 \leqq l \leqq 0.006B+1.1$$

where the unit of magnetic flux density is gauss and the unit of the shortest distance l is mm. Accordingly, the scatter and leakage of developer from the opening of the developing device can be effectively prevented, so that the developing device can be prevented from being stained.

What is claimed is:

1. A developing device for use in an image recording apparatus, comprising:

(a) a developer stirring means for stirring developer;
(b) a developer supply means for supplying the developer stirred by the developer stirring means;
(c) a developer holding means for attracting the supplied developer onto a surface thereof and for conveying the developer to a developing area;
(d) a height regulating means for regulating a layer thickness of the developer on the surface of the developer holding means;
(e) a developer removing means for removing residual developer from the surface of the developer holding means after development;
(f) a magnetic conveying means for conveying the removed residual developer toward the developer stirring means; and
(g) a mechanical conveying means for removing developer from the surface of the magnetic conveying means and for conveying the developer to the developer stirring means, the mechanical conveying means being disposed between the magnetic conveying means and the developer stirring means.

2. The developing device of claim 1, wherein the mechanical conveying means is composed of a non-magnetic body, and one end of which is placed adjacent to or in contact with a surface of the magnetic conveying means in the region between the magnetic conveying means and the developer stirring means, and the other end of which is connected with the developer removing means.

3. The developing device of claim 1, wherein the mechanical conveying means is a laminated member composed of a non-magnetic layer and a magnetic layer, and one end of which is placed between the magnetic conveying means and the developer stirring means so that the non-magnetic layer is adjacent to or in contact with the surface of the magnetic conveying means, and the other end of which is connected to the developer removing means.

4. The developing device of claim 1, wherein one end of the mechanical conveying means adjacent to the developer stirring means is remote from the magnetic conveying means in the range between zero and 1 mm.

5. The developing device of claim 1, wherein the other end of the mechanical conveying means is connected to the developer removing means.

6. The developing device of claim 1, wherein the developer removing means is provided with a resilient and sharp edge portion.

7. The developing device of claim 6, wherein the developer removing means is made from one of urethane rubber, phosphor bronze and polyethylene terephthalate.

8. The developing device of claim 1, wherein the magnetic conveying means is composed of moving magnet means which moves magnet field in the direction of carrier movement.

9. The developing device of claim 1, wherein the non-magnetic body is made from one of stainless steel, aluminum and rubber.

10. The developing device of claim 1, wherein the developer contains magnetic carrier particles and toner particles.

11. The developing device of claim 1, further comprising a housing means having an opening at one end and comprising a developer leakage prevention means having a magnet with reverse polarity to and aligned to be in opposition with a magnet of the developer holding means, wherein the developer leakage prevention means is provided adjacent to a lower edge of the opening between the lower edge of the opening and the developer removing means.

12. The developing device of claim 1, wherein the length of the magnetic conveying means in the axial direction is greater than that of a magnet inside the developer holding means.

13. A developing device for use in an image recording apparatus, comprising:

(a) a housing means having an opening at one end;

(b) a developer holding means for attracting developer onto a surface thereof, the developer holding means being disposed within the housing means so as to protrude from the opening and to be spaced from each of the upper and the lower edge of the opening;

(c) a height regulating means for regulating a layer thickness of the developer attracted to the surface of the developer holding means;

(d) a developer stirring means for stirring developer;

(e) a developer supply means for supplying the developer stirred by the developer stirring means;

(f) a developer removing means for removing residual developer attracted on the surface of the developer holding means, one end of the developer removing means being in contact with the developer holding means; and (g) a developer leakage prevention means comprising a magnet with reverse polarity to and aligned to be in opposition with a magnet of the developer holding means, the developer leakage prevention means being provided adjacent to the lower edge of the opening of the housing means between the lower edge of the housing means and the developer removing means.

14. The developing device of claim 13, wherein there is provided with magnetic conveying means, which is disposed between the developer removing means and the developer stirring means, for conveying the developer removed from the developer holding means to the region where the developer stirring means is located.

15. The developing device of claim 13, wherein the developer leakage prevention means is composed of a rubber-magnet.

16. The developing device of claim 13, wherein the magnetic flux density of the magnet used in the developer leakage prevention means is between 200 and 400 gauss, and the shortest distance between the developer leakage prevention means and the developer holding means is in the range of 2 to 4 mm, and the relation between the magnetic flux density of the developer leakage prevention means and the shortest distance is given by the equation of:

$$0.006B+0.7 \leqq L \leqq 0.006B+1.1$$

in which the unit of the magnetic flux density (B) is expressed by gauss and the unit of the shortest distance (L) is expressed by mm.

17. The developing device of claim 16, wherein the developer contains magnetic carrier particles and toner particles.

18. The developing device of claim 13, wherein the developer contains magnatic carrier particles and toner paticles.

19. A developing device for use in an image recording apparatus, comprising:

(a) a housing means having an opening at one end;

(b) a developer holding means for attracting developer supplied by a developer supply means onto a surface thereof, the developer holding means being disposed within the housing means so as to protrude from the opening and to be spaced from each of the upper and the lower edge of the opening;

(c) a height regulating means for regulating a layer thickness of the developer attracted to the surface of the developer holding means;

(d) a developer stirring means for stirring developer;

(e) the developer supply means for supplying the developer stirred by the developer stirring means;

(f) a developer removing means for removing residual developer attracted on the surface of the developer holding means; and (g) a magnetic conveying means for conveying the removed residual developer toward the developer stirring means, the length of the magnetic conveying means in the axial direction being greater than the corresponding length of a magnet means constituting the developer holding means.

20. The developing device of claim 19, wherein if the length of magnetic means constituting the developer holding means is not the same as the sandblasted width, the axial length of the magnetic conveying means is greater than any of the length of the magnetic means and the sandblasted width.

* * * * *

UNITED STATES PATENT AND TRADEMARK OFFICE

CERTIFICATE OF CORRECTION

PATENT NO. : 5,065,693

DATED : November 19, 1991

INVENTOR(S) : Kunihisa Yoshino et al.

It is certified that error appears in the above-identified patent and that said Letters Patent is hereby corrected as shown below:

Column 24, claim 18, line 26, change "paticles" to --particles--.

Signed and Sealed this

Twenty-ninth Day of June, 1993

Attest:

Michael K. Kirk

MICHAEL K. KIRK

Attesting Officer

Acting Commissioner of Patents and Trademarks